United States Patent [19]

Neuhierl

[11] 4,096,658

[45] Jun. 27, 1978

[54] TOY MODEL VEHICLE TRACK SUPPORT SYSTEM

[76] Inventor: Hermann Neuhierl, Waldstrasse 36, D-8510 Fürth, Bayern, Germany

[21] Appl. No.: 779,602

[22] Filed: Mar. 21, 1977

[30] Foreign Application Priority Data

May 21, 1976 Germany ..... 2622824

[51] Int. Cl.[2] ..... A63H 33/06

[52] U.S. Cl. ..... 46/17; 46/30

[58] Field of Search ..... 46/1 K, 16, 17, 30, 46/31, 216

[56] References Cited

U.S. PATENT DOCUMENTS

| | | | |
|---|---|---|---|
| 249,448 | 11/1881 | Barnes | 46/17 |
| 2,070,887 | 2/1937 | Dunn, Jr. et al. | 46/17 |
| 2,442,526 | 6/1948 | Wright | 46/17 |
| 2,968,118 | 1/1961 | Paulson | 46/31 |
| 3,225,487 | 12/1965 | Mallalieu | 46/17 |
| 3,405,458 | 10/1968 | Sylwan | 46/31 |
| 3,896,582 | 7/1975 | Cohen | 46/17 |

*Primary Examiner*—Louis G. Mancene
*Assistant Examiner*—Robert F. Cutting
*Attorney, Agent, or Firm*—Haseltine, Lake & Waters

[57] ABSTRACT

A support system for track for toy model vehicles comprises paired pylons for positioning one on each side of the track and connected together through means for supporting the track where it passes between the paired pylons. The pylons are formed from a plurality of substantially flat elements including a base plate, a top piece and, generally, at least one intermediate piece. These elements are substantially horizontal and are spaced apart by means of side pieces which interlock the horizontal elements at each end thereof. The supporting means are connected to the pylons intermediate successive pairs of horizontal elements.

21 Claims, 10 Drawing Figures

TOY MODEL VEHICLE TRACK SUPPORT SYSTEM

This invention relates to a support system for tracks for toy model vehicles, for example toy car racing tracks and model railways.

Support systems are known for tracks for model vehicles which comprise pylons arranged on both sides of the track and carrying the track possibly at a number of different levels. Such pylons are generally built up from a number of basic components which are manufactured as hollow pieces. By taking pylons apart, it is possible to re-use the component elements to produce pylons of different height in accordance with a particular desired track height. The manufacture of the basic individual elements as hollow pieces, is, however, complicated and expensive. The joining of such components to one another to obtain a complete support system is also difficult. Moreover, they are very bulky so that special packaging problems arise.

It is an object of this invention to provide a support system which can be assembled from simple flat component parts.

According to one aspect of the present invention, there is provided a support system for track for toy model vehicles, comprising paired pylons for positioning one on each side of the track and connected together through means for supporting the track where it passes between the paired pylons, the pylons being formed from a plurality of substantially flat elements including a base plate, an upper piece and side pieces which interlock both the base plate and the upper piece, the supporting means being connected to the pylons intermediate the base plate and the upper piece.

The invention also provides an assemblage for use in the construction of a support system as aforesaid, which comprises at least two base plates, at least two upper pieces and at least four side pieces for interlocking pairs of side pieces between a base plate and an upper piece thereby to produce two pylons, and track supporting means of longitudinal form adapted at each end thereof for affixing to a said pylon thereby to be able to support a track for toy model vehicles as it passes thereover between the pylons at a position intermediate the base plates and upper pieces thereof.

Finally, this invention provides a track system for toy model vehicles comprising a support system as aforesaid having track passing between every pylon pair over the supporting means.

A preferred mode of connecting the side pieces to the base plate and the upper piece is one in which the side pieces are formed with hooks which engage in corresponding slots in the base plate and the upper piece. It is possible for several upper pieces to be employed to produce, in the ascending direction, repeating arrangements of side pieces and upper pieces, each upper piece serving as a base plate for affixing of further side pieces, the assembly thereby produced being finally covered by a top piece serving as a special form of upper piece and attached to the uppermost side pieces.

The pylons may comprise, in addition, transverse side pieces which may be supported in vertical grooves formed by ribs on the side pieces which then extend parallel to the track. These transverse side pieces may have extension lugs which engage in suitably sized slots in the base plate and in the upper piece. In this way, all the side pieces may be firmly locked together and together form a load bearing, substantially rigid, pylon component element. When an upper piece lies intermediate between two sections of a pylon, particularly rigid fastening of the side pieces may be obtained if the hooks formed on the upper side pieces are doubly stepped. Locking connection to the upper piece is then effected by way of the upper portion of these hooks, whilst the lower portion of the hooks becomes hooked to a side piece therebelow.

The model vehicle track itself may be supported between pairs of pylons by way of bracing cables extending from bracing rings arranged on the transverse side pieces of the pylon sections down to track cable fixing clamps and up therefrom to cable bracing devices.

Track supports which may engage in slots disposed in the side pieces between the guide ribs for the transverse side pieces may thus be arranged between the pylons and be firmly connected to the pylons. In order to make room for hooks of such track supports in the region of the transverse side pieces, the transverse side pieces are preferably coped in this region. With a pylon support system according to the present invention it is possible for the track to lie directly on the aforesaid track supporting means. Alternatively, a track support plate is laid on the track supports and the actual track rests on this.

For a better understanding of the invention and to show how the same can be carried into effect, reference will now be made, by way of example only, to the accompanying drawings, wherein.

Figure 1:
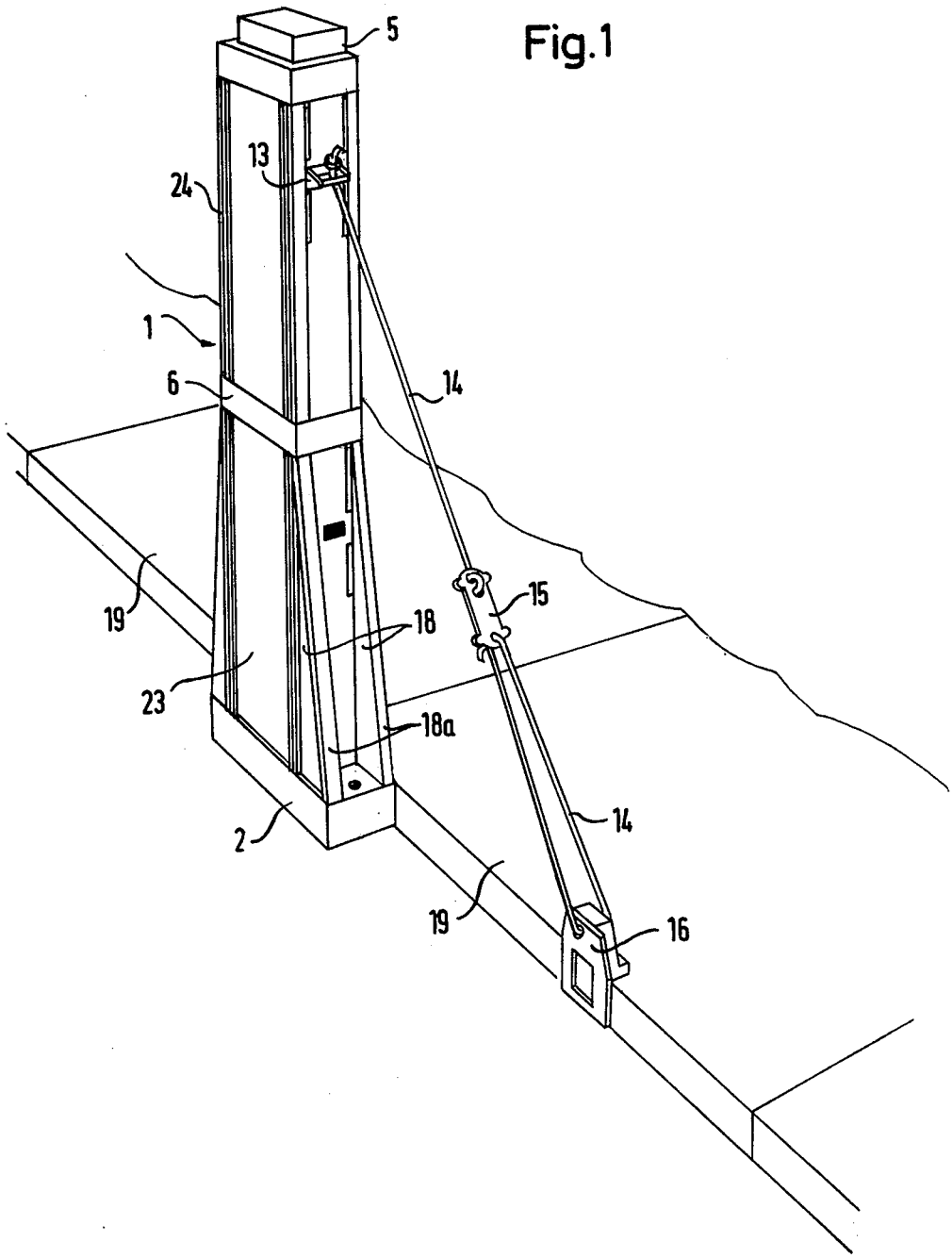
FIG. 1 shows a perspective view, with part cut away of a pylon connected to a toy vehicle track.

Referring to FIG. 1 of the drawings, a pylon 1 which is to carry at least one model vehicle track above a track 19 at its base level comprises two pylon sections 23 and 24 and accordingly is formed from a base plate 2, a top piece 5 and an intermediate piece 6. Knee-plate-like reinforcing plates 18 provided externally with flanges 18*a* can be seen to support the pylon in the lower section thereof. Securing of the pylon in the vertical position is achieved by means of bracing cables 14 (only one of which is shown) extending from rings 13 in upper regions of the pylon through fastening clamps 16 to cable bracing devices 15.

Figure 2:
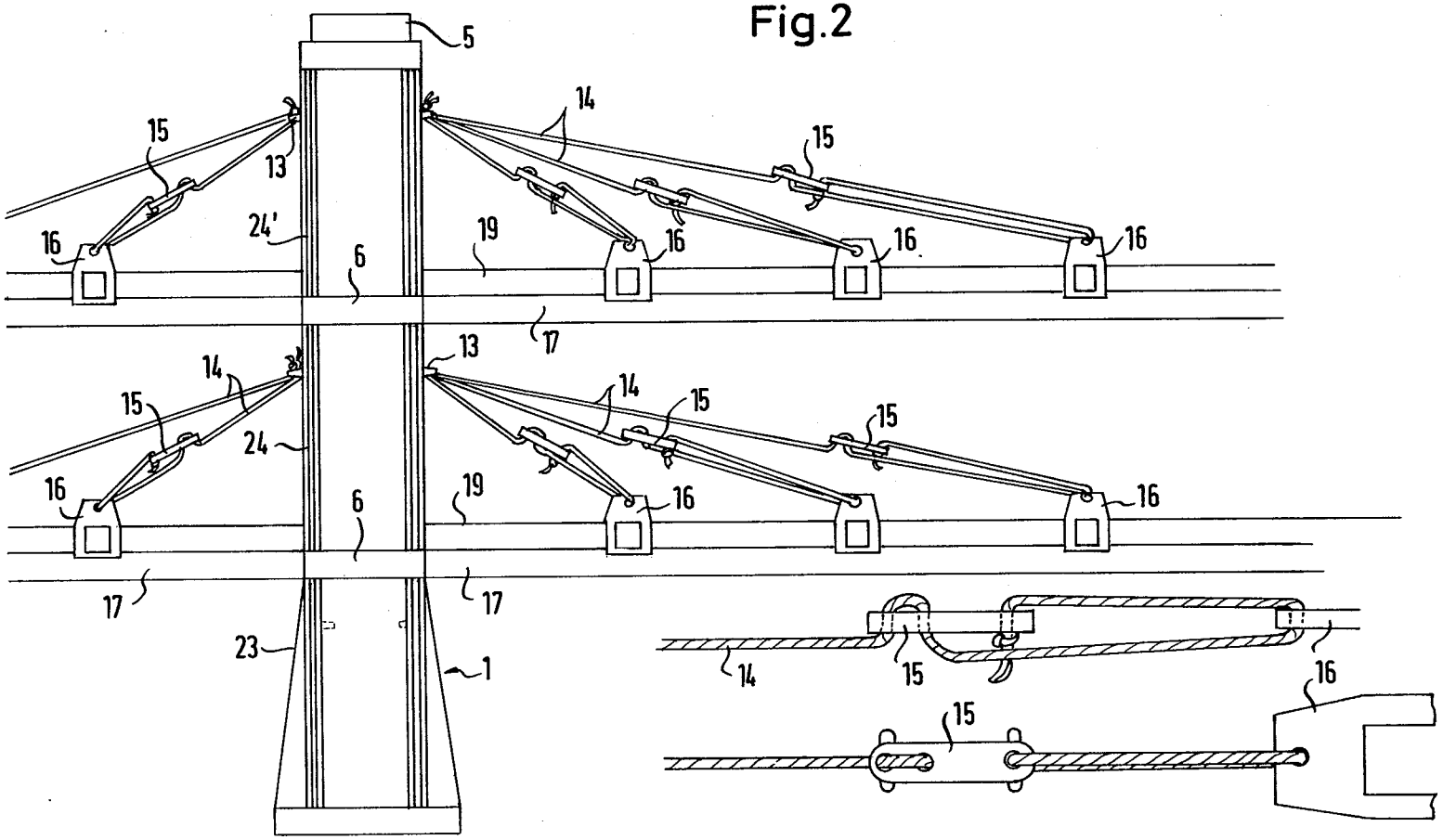
FIG. 2 shows, in elevation, a pylon having two tracks suspended thereon one above the other, as well as showing details of track suspension means on an enlarged scale.

Referring next to FIG. 2, the use of a pylon 1, here being a three-section pylon having sections, 23, 24 and 24' and two intermediate pieces 6 in the support above base level of two model vehicle track levels can be seen. Each of the tracks is connected to the pylon at a ring 13 by means of three bracing cables 14 on each side thereof, each bracing cable passing through a fastening clamp 16 to a cable bracing device 15. In this case, each of the track levels is carried on a track support plate 17. The manner in which the cable 14 is passed through the fastening clamp 16 into the cable bracing device 15 can be seen particularly clearly from the two views at right angles to each other shown in the bottom right-hand corner of FIG. 2. With such an arrangement, the track parts are supported at a distance from the pylons and held at a uniform level so that bowing of the track is avoided.

Figure 3:
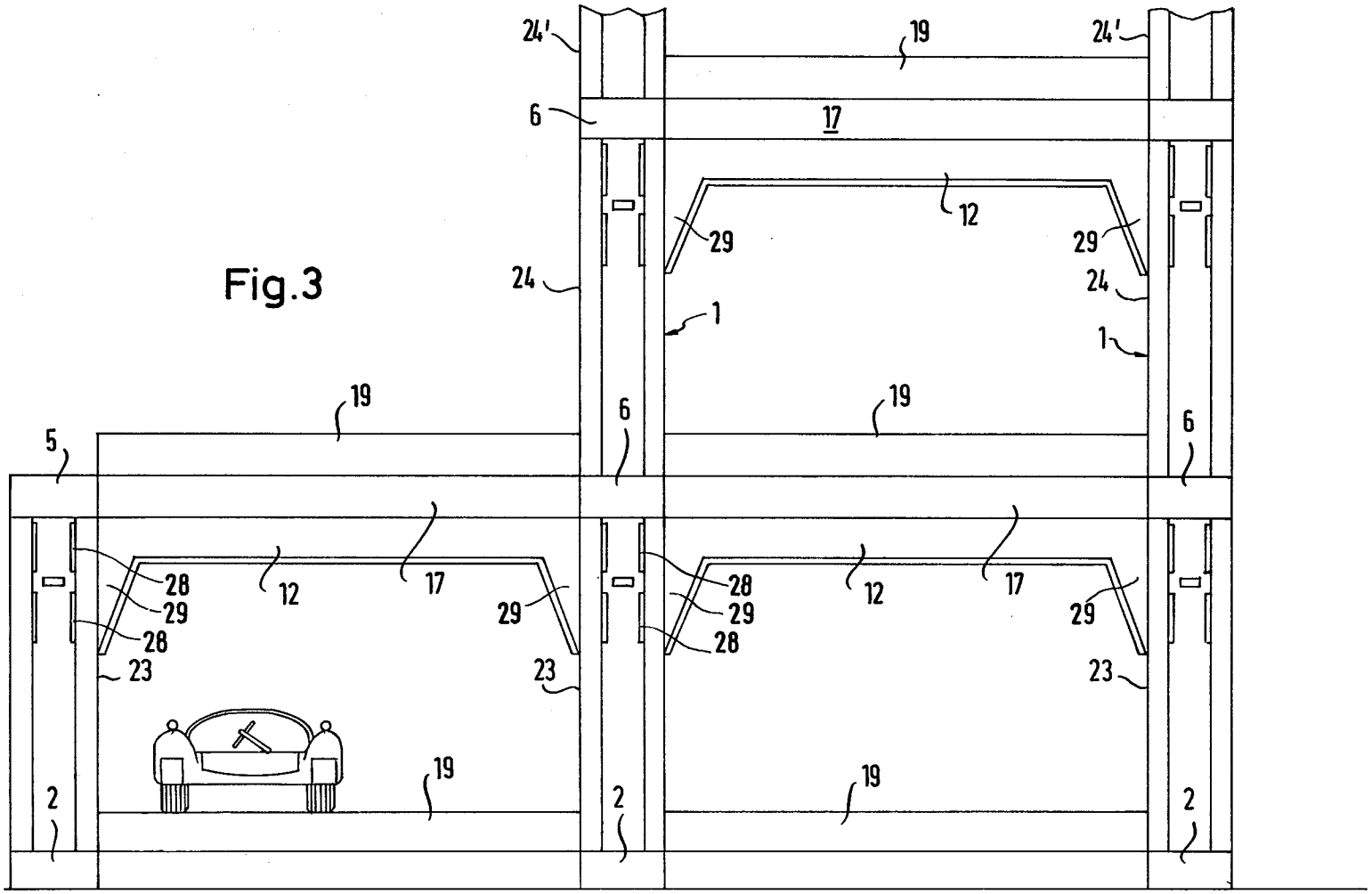
FIG. 3 shows a cross-section through a track system having several tracks arranged adjacent and above one another.

FIG. 3 is a view at right angles to that shown in FIG. 2 showing an arrangement of three pylons in a line. Thus two pairs of tracks are disposed in side-by-side arrangement. Moreover, the central and right-hand pylons are higher than the left-hand pylon and thus three tracks are shown carried by these pylons in the right-hand part of the Figure. Each adjacent pair of pylons is firmly joined together by means of track support 12 which have hook-like projections which engage in slots 21*a* in the side pieces 3 (see FIG. 4). In order to be able to set different track heights, two such slots 21*a* are provided below each other. In order to make room for the hook-like projections in the region of transverse side pieces extending between the side pieces 3, the transverse pieces which are not fully shown in FIG. 3 but are shown in FIGS. 5 and 6 are coped in the region 28.

Figures 4, 5, 6, 7, 8, 9, 10:
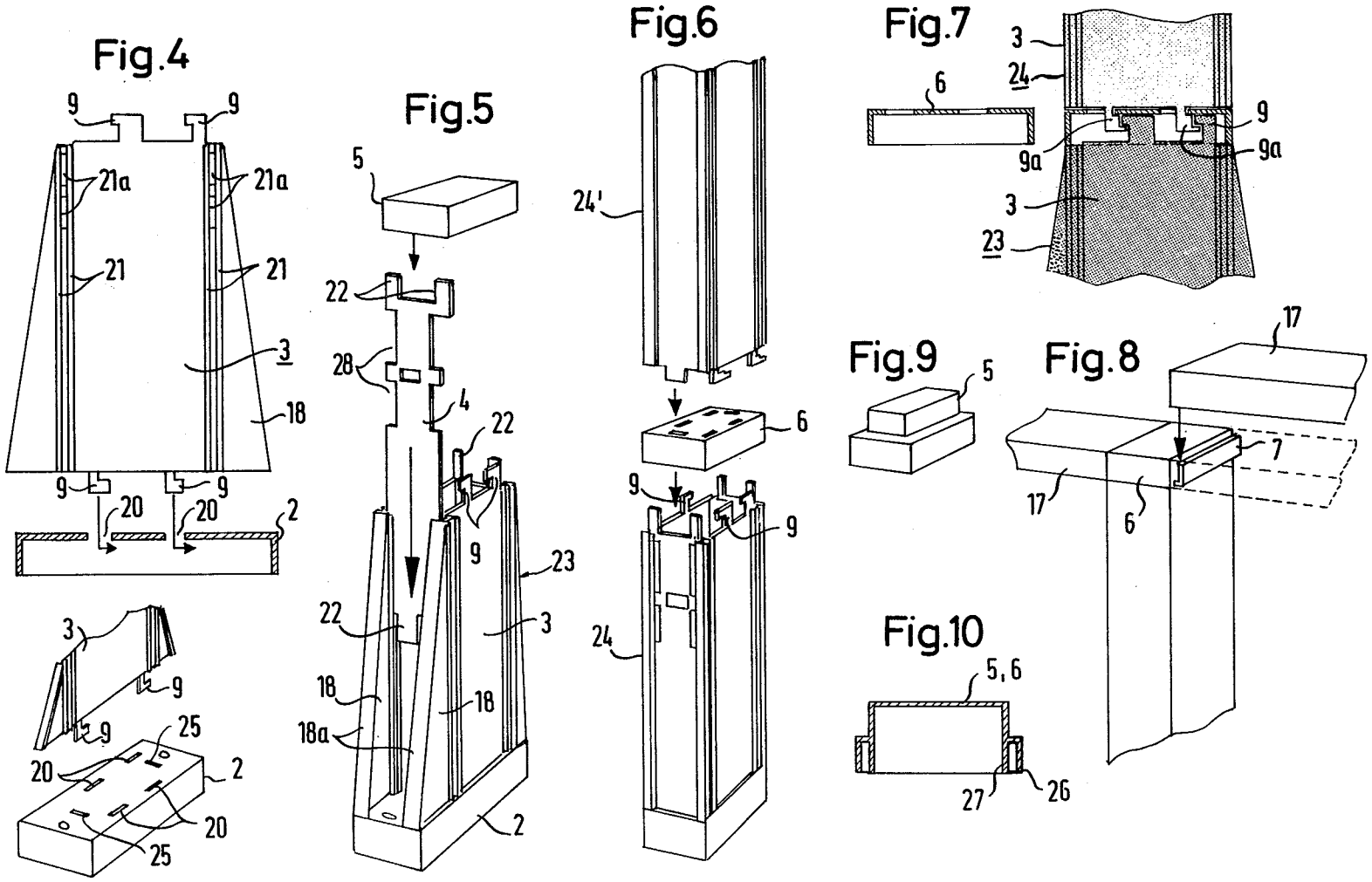
FIG. 4 shows various views of components of a lower section of a pylon for use in a support system embodying this invention.
FIG. 5 shows the components of FIG. 4, when partly assembled.
FIG. 6 is an exploded view of a pair of pylon sections to be joined together.
FIG. 7 shows a cross-section through a connection between two pylon sections, with interposition of an intermediate piece.
FIG. 8 shows the assembly of a track support plate on an intermediate piece.
FIG. 9 shows a pylon top piece in inverted view.
FIG. 10 shows a pylon top piece in cross-section.

The manner of assembly of the pylons can be seen more fully from FIGS. 4 to 10. Thus, referring to FIG. 4, the uppermost drawing shows, in elevation, one side of a side piece 3 having positioned therebelow and shown in section a base plate 2. The third drawing of FIG. 4 shows the lower part of the base plate 3 in perspective and the bottommost part of FIG. 4 shows the base plate 2 in perspective view. As can be seen from FIG. 4, the base plate 2 is provided with slots 20 to receive hooks 9 of a side piece 3 which is to lie parallel to track 19, and with slots 25 lying at right angles to the slots 20. The side pieces 3 have hooks 9 at their upper and lower marginal regions and are sized in accordance with the length of the slots 20 both from the point of view of width and height. The upper hooks 9 are differently dimensioned in the plane of the hook opening and are intended to enter slots in an intermediate piece 6 (not shown in FIG. 4), the different dimensioning being such that the piece 3 can only be assembled in the correct "top-bottom" position since the wider upper hook 9 does not fit into one of the slots 20 in the base plate 2. If the hooks 9 are inserted into the slots 20 of the base plate 2 and moved accordingly, the side pieces 3 become firmly locked to the base plate. The side piece 3 can be seen to be provided with parallel pairs of ribs 21 defining therebetween channels in which the aforesaid slots 21*a* are disposed.

An unintentional movement backwards of the side pieces 3, such that the hook connection would be released again is prevented by the presence of transverse side pieces 4 inserted in the channels between the pairs of ribs 21 on the side pieces 3 as shown in FIG. 5. At their ends, the transverse side pieces 4 are provided with lugs which enter the slots 25 in the base plate 2. FIG. 5, in showing the fitting of transverse side pieces 4 in a pylon also shows particularly clearly the coping 28 in the transverse side pieces and also the extension of the side pieces 3 of a lowermost pylon section 23 by knee-like-plate reinforcing plates 18 which are formed with flanges 18*a*.

FIG. 6 shows the assembly together of a pair of pylon sections 24 and 24' with the provision therebetween of an intermediate piece 6. This has slots similarly disposed to the slots 20 and 25 shown in the base plate 2 in FIG. 4 and the slots are engaged by the hooks 9 or lugs 22 of the side pieces 3 or 4 respectively. In this way, a rigid load-bearing pylon structure can be formed as a hollow body from individual flat unit parts. FIG. 7 shows the manner in which a particularly secure and load-bearing connection of two pylon sections 23 and 24 through an intermediate piece 6 may be achieved. For this purpose, the lower hooks 9*a* of the side pieces 3 of the pylon section 24 are doubly stepped. The upper step serves to achieve connection of the side piece of the section 24 to the intermediate piece 6 and the lower step shown at 9*a* serves to receive the hook 9 of the side piece 3 of the lower pylon section.

As already mentioned, in the region between pylons 1 lying opposite one another on both sides of a track 19, the track may rest on a track support plate 17 which in turn rests on track supports 12. As can be seen from FIG. 8, the track support 17 may engage the intermediate piece 6 with its edges by means of a hook rail 7, so that a non-displaceable transverse connection is formed.

Finally, FIGS. 9 and 10 show one constructional form of top piece 5 which may be employed at the top of pylons of support structures according to this invention. As can be seen from FIG. 10, the top piece 5 comprises guide slots defined by an inner wall 27 spaced apart from an outer wall 26 and serving to receive hooks 9 or lugs 22 on the upper ends of side pieces 3 and 4 respectively.

As will be appreciated from the foregoing, a support system may be constructed for a toy track layout by ready assembly from simple individual flat components to produce a stable, rigid and load-bearing overall system. Variants from the above described system may be produced in accordance with the present invention. One such variant has already been described whereby the support plate is omitted and the track 19 is laid directly on track supports 12. This is preferable particularly in the case of high bridges in order deliberately to obtain a less firm arrangement. Such an arrangement would also enable the track 19 to be more readily varied in its height between two successive pairs of pylons.

I claim:

1. A support system for track for toy model vehicles comprising paired pylons, said pylons being positioning one on each side of the track and connected together through means for supporting the track where it passes between the paired pylons, the pylons being formed from a plurality of substantially flat elements including a base plate, an upper piece and side pieces which interlock both the base plate and the upper piece, the supporting means being connected to the pylons intermediate the base plate and the upper piece.

2. A support system as claimed in claim 1, in which the side pieces extend parallel to the direction to be adopted by said track and are provided at their upper and lower margins with hook formations, the base plate being formed with slots engaged by said hook formations.

3. A support system as claimed in claim 2, wherein the upper piece has a guide rail at the periphery thereof and engaged by said hook formations.

4. A support system as claimed in claim 1, wherein pairs of vertical ribs which form guide grooves therebetween are disposed on the side pieces, opposed guide grooves between them holding in position transverse side pieces of the pylons.

5. A support system as claimed in claim 4, wherein the transverse side pieces are provided at their upper and lower edge regions with lugs which enter corresponding slots in the base plate.

6. A support system as claimed in claim 4, wherein the transverse side pieces are provided at their upper and lower edge regions with lugs which enter corresponding slots in the base plate and lugs positioned at the top of the pylon engage in a guide rail at the periphery of the upper piece.

7. A support system as claimed in claim 1, wherein the side pieces interlocking the base plate are laterally extended by knee-plate-like reinforcing plates which are provided externally with flanges.

8. A support system for track for toy model vehicles, comprising paired pylons, said pylons being positioning one on each side of the track and connected together through means for supporting the track where it passes between the paired pylons, the pylons being formed from a plurality of substantially flat elements including a base plate, a top piece and at least one intermediate piece which extend horizontally with the at least one intermediate piece between the base plate and the top piece, and side pieces between successive pairs of base plate, at least one intermediate piece and top piece to interlock the horizontal elements between which they are positioned, the supporting means being connected to the pylons intermediate pairs of horizontal elements.

9. A support system as claimed in claim 8, in which the side pieces extend parallel to the direction to be adopted by said track and are provided at their upper and lower margins with hook formations, the base plate and at least one intermediate piece being formed with slots engaged by said hook formations.

10. A support system as claimed in claim 9, wherein the top piece has a guide rail at the periphery thereof and engaged by said hook formations.

11. A support system as claimed in claim 8, wherein pairs of vertical ribs which form guide grooves therebetween are disposed on the side pieces, opposed guide grooves between them holding in position transverse side pieces of the pylons.

12. A support system as claimed in claim 11, wherein the transverse side pieces are provided at their upper and lower edge regions with lugs which enter corresponding slots in the base plate and at least one intermediate piece positioned thereadjacent.

13. A support system as claimed in claim 8, wherein side pieces interlocking the base plate are laterally extended by knee-plate-like reinforcing plates which are provided externally with flanges.

14. A support system as claimed in claim 9, wherein hook formations at the lower edge regions of side pieces positioned above said at least one intermediate piece are doubly stepped, the upper step of the hook formation hooking under the top surface of an intermediate piece and the lower step of the hook formation being engaged by the hook formation of the upper edge region of the side piece below said intermediate piece.

15. A support system as claimed in claim 8, wherein upwardly projecting bracing rings are disposed on each of the opposed transverse side pieces and at least one bracing cable is attached to each bracing ring and extends to cable fixing clamps for engaging the track and terminates in a cable bracing device.

16. A support system as claimed in claim 11, wherein track supports extend between paired pylons engaging the pylons through slots formed in said guide grooves.

17. A support system as claimed in claim 11, wherein track supports extend between paired pylons engaging the pylons through slots formed in said guide grooves and further comprising track support plates resting on said track supports and the ends of which engage over hook rails on intermediate pieces of the pylons.

18. A support system as claimed in claim 16, wherein at least two said slots are disposed in line in said guide grooves and the track supports are provided with elongate supporting arms on which there are provided two engagement hooks arranged one above the other and which engage in said slots.

19. A support system as claimed in claim 17, wherein at least two said slots are disposed in line in said guide grooves and the track supports are provided with elongate supporting arms on which there are provided two engagement hooks arranged one above the other and which engage in said slots.

20. A support system as claimed in claim 1 and carrying track for toy model vehicles on the supporting means.

21. A support system as claimed in claim 8, and carrying track for toy model vehicles on the support means.

* * * * *